US006987366B2

(12) United States Patent
Yu

(10) Patent No.: US 6,987,366 B2
(45) Date of Patent: Jan. 17, 2006

(54) STEP DOWN CIRCUIT FOR AN LED FLASHLIGHT

(76) Inventor: Sun Yu, 2850 Coolidge, Berkley, MI (US) 48072

( * ) Notice: Subject to any disclaimer, the term of this patent is extended or adjusted under 35 U.S.C. 154(b) by 47 days.

(21) Appl. No.: 10/334,624

(22) Filed: Dec. 31, 2002

(65) Prior Publication Data

US 2004/0124782 A1 Jul. 1, 2004

(51) Int. Cl.
*G05F 1/00* (2006.01)
*F21L 4/04* (2006.01)

(52) U.S. Cl. ..... 315/291; 362/205

(58) Field of Classification Search ..... 315/200 A, 315/291, 307; 362/202–205, 208; G05F 1/00; F21L 4/04
See application file for complete search history.

(56) References Cited

U.S. PATENT DOCUMENTS 4,948,210 A * 8/1990 Simms ..... 359/356
5,309,336 A * 5/1994 Hartt et al. ..... 362/183
5,357,419 A 10/1994 Limpaecher ..... 363/140
5,424,927 A * 6/1995 Schaller et al. ..... 362/157
5,442,260 A 8/1995 Saito et al. ..... 315/241 P
5,528,472 A 6/1996 Maglica et al. ..... 362/206
5,685,632 A * 11/1997 Schaller et al. ..... 362/205
5,764,501 A 6/1998 Limpaecher ..... 363/61
5,806,960 A 9/1998 Chien ..... 362/84
5,869,936 A 2/1999 Horinishi et al. ..... 315/241
5,909,952 A 6/1999 Guthrie et al. ..... 362/205
5,947,580 A 9/1999 Chien ..... 362/84
6,074,072 A 6/2000 Parsons et al. ..... 362/202
6,095,661 A 8/2000 Lebens et al. ..... 362/184
6,366,028 B1 4/2002 Wener et al. ..... 315/241 P
2001/0033503 A1 * 10/2001 Hamp et al. ..... 363/73
2004/0108841 A1 * 6/2004 Arthur ..... 323/222

* cited by examiner

*Primary Examiner*—Thuy Vinh Tran
(74) *Attorney, Agent, or Firm*—Gifford, Krass, Groh, Sprinkle, Anderson & Citkowski, P.C.

(57) ABSTRACT

The present invention relates to a voltage reducing circuit for use with an LED flashlight. The LED flashlight according to the invention comprises a battery, a solid state light source having an on voltage less than the voltage of the battery, and a voltage reducing circuit in electrical communication with the battery and the solid state light source. The voltage reducing circuit is operative to reduce the voltage from the battery to a level that is slightly above the on-voltage threshold of the solid state light source. In this manner, power expended from the battery by the solid state light source is minimized such that the need for battery replacement is prolonged.

11 Claims, 1 Drawing Sheet

STEP DOWN CIRCUIT FOR AN LED FLASHLIGHT

FIELD OF THE INVENTION

The present invention relates to handheld lights such as flashlights, but more particularly to a miniature flashlight that includes a voltage reducing circuit for reducing power from the power source to the light source.

BACKGROUND OF THE INVENTION

Flashlights of various sizes and shapes are well known in the art. Many use two or more dry cell batteries arranged in a housing as a source of electrical energy.

Battery technology is such that as electrical power is withdrawn from the battery cell, the voltage available across a given current load will decrease. In the case of a flashlight, this decrease of available voltage across the load causes reduced light output, gradually dimming the light as the battery charge depletes.

To prolong battery life, light emitting diodes (LEDs) are becoming more common as light sources for handheld flashlights, especially miniature flashlights. There are other advantages to using LEDs as opposed to other light sources in handheld flashlights. For example, LED bulbs are more durable, longer lasting and energy efficient than incandescent light bulbs. In contrast to regular incandescent bulbs, LEDs do not have a filament. Incandescent bulbs rely on filaments for conducting current that results in light being emitted from the bulbs. These filaments are easily broken or burned out, which requires bulb replacement quite frequently.

Most importantly, LEDs are extremely efficient. They have a battery life that is 10 to 15 times that of regular incandescent lights and consume less than 10% of the energy of an incandescent lamp. As such, the need to replace the batteries in an LED flashlight as opposed to an incandescent bulb flashlight is much less.

The energy emitted by an LED is related to the electrical charge q of an electron and the voltage V required to light the LED by the expression: $E=qV$. By substituting known values for q and V into this equation, it is apparent that LEDs require very little energy to emit light, thus minimizing the need to replace batteries as frequently. Because the energy requirements for LEDs are so low, many developers of LED flashlights utilize very low voltage battery cells which are small in size but hold an adequate charge for driving an LED to emit light for many hours. Thus, the present invention seeks to minimize the need for battery replacement even more by providing a flashlight that utilizes a larger battery having a higher voltage to further minimize the need for replacement in LED flashlights.

SUMMARY OF THE INVENTION

The present invention provides a voltage reducing circuit for a handheld flashlight to obviate the need for frequent battery replacement.

The flashlight of the present invention includes a battery and a light emitting device having an on-voltage threshold that is less than the voltage or potential difference stored in the battery.

A voltage reducing circuit such as a DC/DC converter is provided in electrical communication with the battery and the light emitting device. The voltage reducing circuit is operative to reduce the voltage received from the battery to a voltage level equal to or slightly above the on-voltage of the light emitting device causing it to illuminate. In this fashion, power dissipation is minimal because the majority of the energy being expended in the circuit is due to the light emitting device itself with a negligible amount being utilized by the voltage reducing circuit.

A housing is provided to support the battery, the light emitting device and the voltage reducing circuit therein such that the light emitting device is capable of emitting light from the housing once its on-voltage has been received.

BRIEF DESCRIPTION OF THE DRAWINGS

A better understanding of the present invention will be had upon reference to the following detailed description when read in conjunction with the accompanying drawings wherein like reference characters refer to like parts in which.

DETAILED DESCRIPTION OF THE INVENTION

Due to the small amount of energy expended by LEDs during illumination, most LED flashlights utilize very low voltage battery cells that are small in size but hold an adequate charge for driving an LED to emit light for many hours before battery replacement is required. The present invention operates to minimize the need for battery replacement even more by providing a flashlight that utilizes a larger battery having a higher stored charge, relative to a smaller battery, in communication with energy regulating circuit to further minimize the need for battery replacement in LED flashlights.

Figure 1:
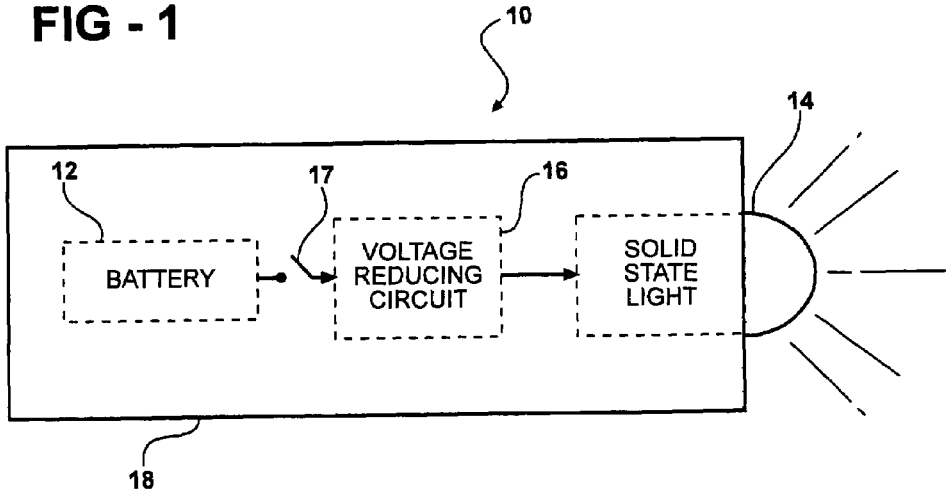
FIG. 1 illustrates a block diagram of a flashlight including the voltage reducing circuit as according to the present invention.

Referring now to FIG. 1, a flashlight is shown generally at 10 that includes a voltage reducing circuit 16.

The flashlight 10 as according to the invention includes a battery 12 for supplying energy to the light emitting device 14 of the flashlight 10. The battery 12 is selected for use in the flashlight 10 such that its voltage level or potential difference is greater than the on-voltage threshold of the light emitting device 14. For example, if the on-voltage threshold of the light emitting device 14 is 1.7 volts, then the battery voltage as according to the invention may be 5 or more volts.

It is appreciated that the charge of a battery 12 is directly proportional to its voltage level or potential difference. Thus, choosing a battery 12 that has a higher voltage level operates to reduce the need for battery replacement when used in the flashlight 10 as according to the invention.

Many types of batteries may be used in the present invention including alkaline, lithium ion, nickel cadmium, or other chemistry suitable for the intended purpose and having a voltage level greater than the on-voltage threshold of the light emitting device 14. The battery 12 or batteries used may also be rechargeable and/or recyclable and packaged as button cell, canister shape or other conventional forms suitable for such purpose.

Preferably, the flashlight 10 of the present invention utilizes a light emitting device 14 that is a solid state device.

Most preferably, the solid state device is a light emitting diode (LED) but other types of low power solid state devices that emit light may be used which illustratively includes lasers and laser diodes. It is appreciated that other types of light sources may be used including incandescent bulbs. LEDs are most desirable due to the relatively low cost and durability however these general characteristics are not intended to be limiting on the scope of the invention.

A voltage reducing circuit 16 is placed in communication with the battery 12 and the light emitting device 14 such that the voltage reducing circuit 16 electrically connects to the positive and negative poles of the battery 12 as well as the positive and negative terminals of the light emitting device 14. The voltage reducing circuit 16 operates to reduce the voltage received from the battery 12 to a level equal to or above the on-voltage threshold of the light emitting device 14. In this manner, the light emitting device is only supplied the voltage necessary to remain on in a steady state condition.

Figure 3:
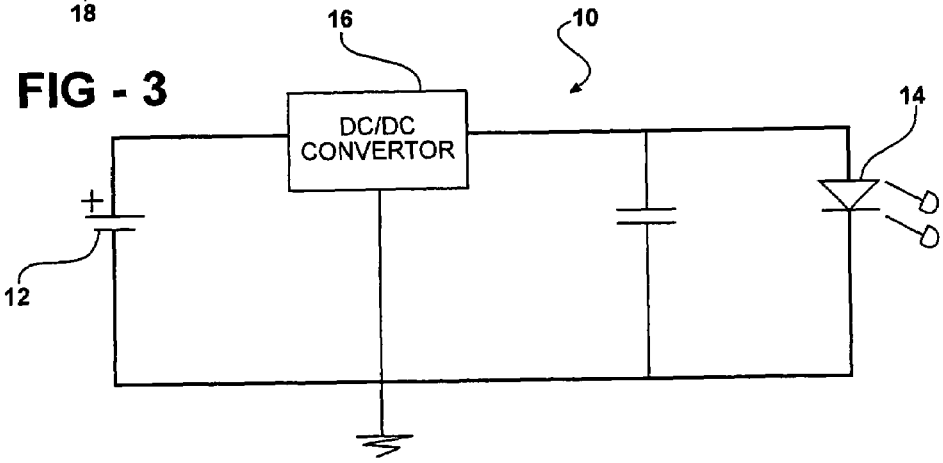
FIG. 3 illustrates a schematic view of a flashlight that exemplifies a voltage reducing circuit which may be used in constructing the present invention.

Preferably, the voltage reducing circuit 16 imposes a minimal drain on the battery power as compared to that of the light emitting device 14. FIG. 3 exemplifies a flashlight 10 as according to the present invention where the voltage reducing circuit 16 is a DC/DC converter illustratively from the Texas Instruments TPS6200xDGS series of high efficiency step-down low-power DC/DC converters. The power dissipated by such a circuit is primarily dependent on the power requirements of the light emitting device 14 as the power dissipated by the converter is directly proportional to the current demands of the load. It is appreciated that other transformerless voltage reducing circuits are operative herein and illustratively include a conventional voltage regulator circuit which may regulate the output voltage delivered to the light emitting device to just above the on-voltage threshold similar to the DC/DC converter. Alternatively, a Zener diode may be used as a regulating device to limit the output voltage across a light emitting device 14 to the on-voltage threshold such that power dissipation across the load will be minimal. Still other circuits having the capability of stepping down an input voltage without causing a substantial drain on the power source relative to the load may become apparent to those skilled in the art that without exceeding the scope of the invention.

Preferably, a switch element 17 is included in the flashlight 10 such that an operator may turn the flashlight 10 on and off as desired.

Figure 2:
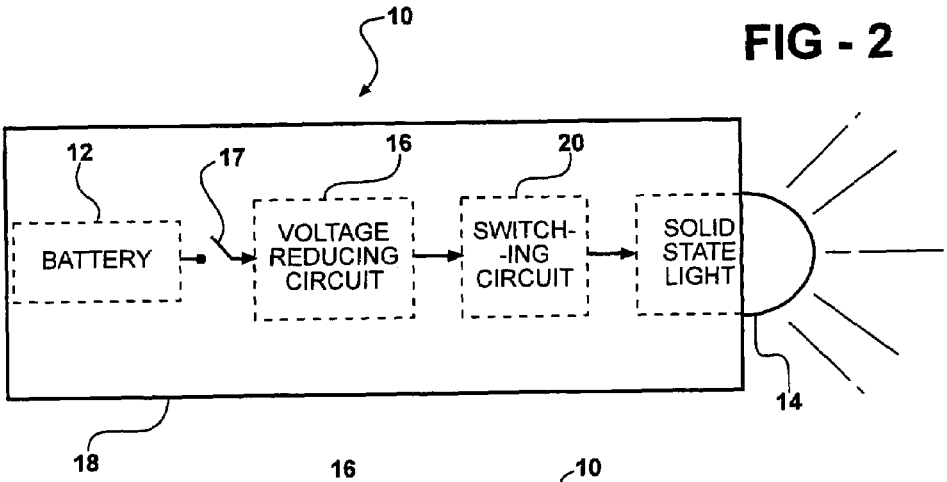
FIG. 2 illustrates an alternative embodiment of the flashlight as according to the invention further including a switching circuit.

As illustrated in FIG. 2, an alternative embodiment further includes a switching circuit 20 that is operative to switch the light emitting device 14 on and off at a rate that causes the light to appear that it is on continuously. Illustratively, the speed at which the light emitting device 14 alternates between an activated/deactivated state is greater than or equal to 60 hertz such that the state changes are not discernable by the human eye. It is appreciated that the switching circuit 20 may also be operative to switch the light emitting device between states at a frequency below 60 hertz which may be desirable for certain situations. Additionally, adding a switching circuit 20 into the flashlight 10 also functions to preserve the power source as switching the power source causes less energy is being delivered to the load over any given period as opposed to a load receiving continuous DC. Pulse width modulation circuitry is commonly used for switching power to a load and may be used herein for such purpose. Alternatively, an astable multivibrator circuit may be employed to accomplish the desired switching thus reducing power dissipation at the load.

A housing 18 is provided for supporting each of the battery 12, the light emitting device 14 and the voltage reducing circuit 16 therein such that the light emitting device 14 emits light from the housing 18 upon receiving a voltage that is greater than or equal to its on-voltage threshold. Preferably, the housing 18 is made of a lightweight hard plastic material formed in an injection molding process. Alternatively, it is appreciated that other materials are operative herein such as various other polymers and metals.

A preferred embodiment of the light as according to the invention is a lightweight handheld device. Ideally, it is sized such that it may be carried on a key ring or in a small carrying case which can be placed in a user's pocket or attached to an outer garment.

From the foregoing it can be seen that the present invention provides a simple and yet effective means of further obviating the need for replacing the battery used in a handheld flashlight that utilizes a solid state light source. Having described the invention, however, many modifications thereto will become apparent to those skilled in the art to which it pertains without deviation from the spirit of the invention as defined by the scope of the appended claims.

I claim:

1. A flashlight comprising:

a battery having a voltage;

a light emitting device having an on-voltage less than the voltage of said battery;

a voltage reducing circuit in electrical communication with said battery and said light emitting device, said voltage reducing circuit operative to reduce the voltage from said battery to greater than or equal to said on-voltage of said light emitting device;

a switch for connecting said battery to said voltage reducing circuit;

a switching circuit operative to switch said light emitting device alternatively on and off at a rate that causes light to appear at steady state; and a housing wherein said battery, said light emitting device, said voltage reducing circuit and said switching circuit are supported such that said light emitting device emits light from said housing upon receiving said on-voltage.

2. The flashlight of claim 1 wherein the flashlight is a miniature flashlight.

3. The flashlight of claim 1 wherein the voltage reducing circuit is transformerless.

4. The flashlight of claim 1 wherein said switching circuit is an astable multi-vibrator circuit.

5. The flashlight of claim 1 wherein said voltage reducing circuit comprises a DC/DC converter.

6. The flashlight of claim 1 wherein said voltage reducing circuit comprises a voltage regulator.

7. The flashlight of claim 1 wherein said voltage reducing circuit comprises a Zener diode.

8. The flashlight of claim 1 wherein the light emitting device is a solid state device.

9. The flashlight of claim 8 wherein the solid state device is a light emitting diode.

10. The flashlight of claim 8 wherein the solid state device is a laser diode.

11. The flashlight of claim 1 wherein the rate of said switching circuit is greater than 60 Hertz.

* * * * *